US010582812B2

(12) United States Patent
Goodman et al.

(10) Patent No.: US 10,582,812 B2
(45) **Date of Patent: *Mar. 10, 2020**

(54) REVERSIBLE PAPER ROLL HOLDER

(71) Applicant: Spectrum Diversified Designs, LLC, Streetsboro, OH (US)

(72) Inventors: Sheldon Goodman, Solon, OH (US); Courtney Wilson, Chardon, OH (US); Matthew Gregory Hanson, Chagrin Falls, OH (US)

(73) Assignee: Spectrum Diversified Designs, LLC, Streetsboro, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/286,658

(22) Filed: Feb. 27, 2019

(65) Prior Publication Data

US 2019/0298118 A1 Oct. 3, 2019

Related U.S. Application Data

(63) Continuation of application No. 15/434,934, filed on Feb. 16, 2017, now Pat. No. 10,398,263.

(51) Int. Cl.
*A47K 10/22* (2006.01)
*A47K 10/38* (2006.01)

(52) U.S. Cl.
CPC ..... *A47K 10/22* (2013.01); *A47K 10/3836* (2013.01)

(58) Field of Classification Search
CPC ..... A47K 10/38; A47K 10/3836; A47K 2010/3863; A47K 10/22; B65H 35/10
See application file for complete search history.

(56) References Cited

U.S. PATENT DOCUMENTS

| | | | |
|---|---|---|---|
| 320,576 | A | 6/1885 | Myers |
| 1,634,746 | A | 7/1927 | Harris |
| 1,687,819 | A | 10/1928 | Worthington |
| 1,692,059 | A | 11/1928 | Starner |
| 2,555,531 | A | 6/1951 | Boord |
| 2,592,571 | A | 4/1952 | Huntington |
| 2,697,562 | A | 12/1954 | Langer |
| 3,067,963 | A | 12/1962 | Suggs |
| 3,227,386 | A | 1/1966 | Pitcher |
| 3,923,265 | A | 12/1975 | Krueger |
| 4,241,885 | A | 12/1980 | Robinson |
| 4,270,706 | A | 6/1981 | Robinson |
| 4,741,486 | A | 5/1988 | Ancona |

(Continued)

FOREIGN PATENT DOCUMENTS

| | | |
|---|---|---|
| DE | 2645184 | 4/1978 |
| DE | 3928806 | 11/1990 |

(Continued)

*Primary Examiner* — William A. Rivera
(74) *Attorney, Agent, or Firm* — Tucker Ellis LLP

(57) ABSTRACT

Provided is a reversible paper roll holder having a support member having a body and a pair of arms extending from respective ends of the body and each having at least one slot, and a support bar having body and at least one protrusion extending radially inward for an inner surface of the body for engaging in the one or more slot of one of the pair of arms to removably secure the support bar to the support member. The holder can be mounted in a left hand and a right hand configuration with the same components, thereby eliminating configuration specific components required to mount in the left hand or right hand configuration.

19 Claims, 12 Drawing Sheets

(56) References Cited

U.S. PATENT DOCUMENTS

| | | | |
|---|---|---|---|
| 5,871,170 | A | 2/1999 | Morales |
| D448,592 | S | 10/2001 | McBride |
| 6,786,377 | B1 | 9/2004 | Holden |
| 7,306,185 | B1 | 12/2007 | Miller |
| 9,661,959 | B2 | 5/2017 | Prior |
| 2011/0101152 | A1 | 5/2011 | Molstad |

FOREIGN PATENT DOCUMENTS

| | | |
|---|---|---|
| FR | 2897606 | 8/2007 |
| GB | 1073205 | 6/1967 |
| KR | 101118522 | 2/2012 |
| WO | 9905952 | 2/1999 |

REVERSIBLE PAPER ROLL HOLDER

RELATED APPLICATIONS

This application is a continuation of U.S. patent application Ser. No. 15/434,934 filed Feb. 16, 2017, which is hereby incorporated herein by reference.

FIELD OF INVENTION

The present invention relates generally to a paper roll holder, and more particularly to a reversible paper roll holder.

BACKGROUND

Paper roll holders are provided in kitchens, bathrooms, offices, etc. for dispensing conventional rolls of paper towels and toilet paper. These holders can be free standing or secured to a wall, for example.

SUMMARY OF INVENTION

Provided is a reversible paper roll holder having a support member having a body and a pair of arms extending from respective ends of the body and each having at least one slot, and a support bar having body and at least one protrusion extending radially inward for an inner surface of the body for engaging in the one or more slot of one of the pair of arms to removably secure the support bar to the support member. The holder can be mounted in a left hand and a right hand configuration with the same components, thereby eliminating configuration specific components required to mount in the left hand or right hand configuration.

In an embodiment, a reversible paper roll holder includes a support member having a u-shaped body and first and second arms extending from first and second ends of the u-shaped body respectively, each of the first and second arms having one or more slots, a bracket configured to be mounted to a surface and including one or more openings through which one of the first and second arms extends, a cover attachable to the bracket to hold the support member in position relative to the bracket and to cover the bracket, and a support bar having a c-shaped body and at least one protrusion extending radially inward for an inner surface of the c-shaped body for engaging in the one or more slot of the other of the first and second arms to removably secure the support bar to the support member.

In another embodiment, a reversible paper roll holder includes a support member having a body and a pair of arms extending from the body parallel one another, a bracket that holds one of the arms of the support member to allow the support member to pivot relative to the bracket, and a support bar removably and non-rotatably attached to the other of the arms, wherein one of the pair of arms is attached to the support bar for a right hand configuration and the other of the pair of arms is attached to the support bar for a left hand configuration.

In still another embodiment, a reversible paper roll holder includes a support member having a u-shaped body and first and second arms extending from respective ends of the u-shaped body, each arm having one or more slots, a bracket configured to be mounted to a surface and including one or more openings through which one of the first and second arms extends, a cover attachable to the bracket to hold the support member in position relative to the bracket and to cover the bracket, and a support bar having a c-shaped body and at least one protrusion extending radially inward for an inner surface of the c-shaped body for engaging in the one or more slot of the other of the first and second arms to removably secure the support bar to the support member, wherein in a left hand configuration the first arm extends through the one or more openings in the bracket and the support bar engages in the one or more slots in the second arm, and in a right hand configuration the second arm extends through the one or more openings in the bracket and the support bar engages in the one or more slots in the first arm.

The foregoing and other features of the application are described below with reference to the drawings.

DETAILED DESCRIPTION

Figure 1:
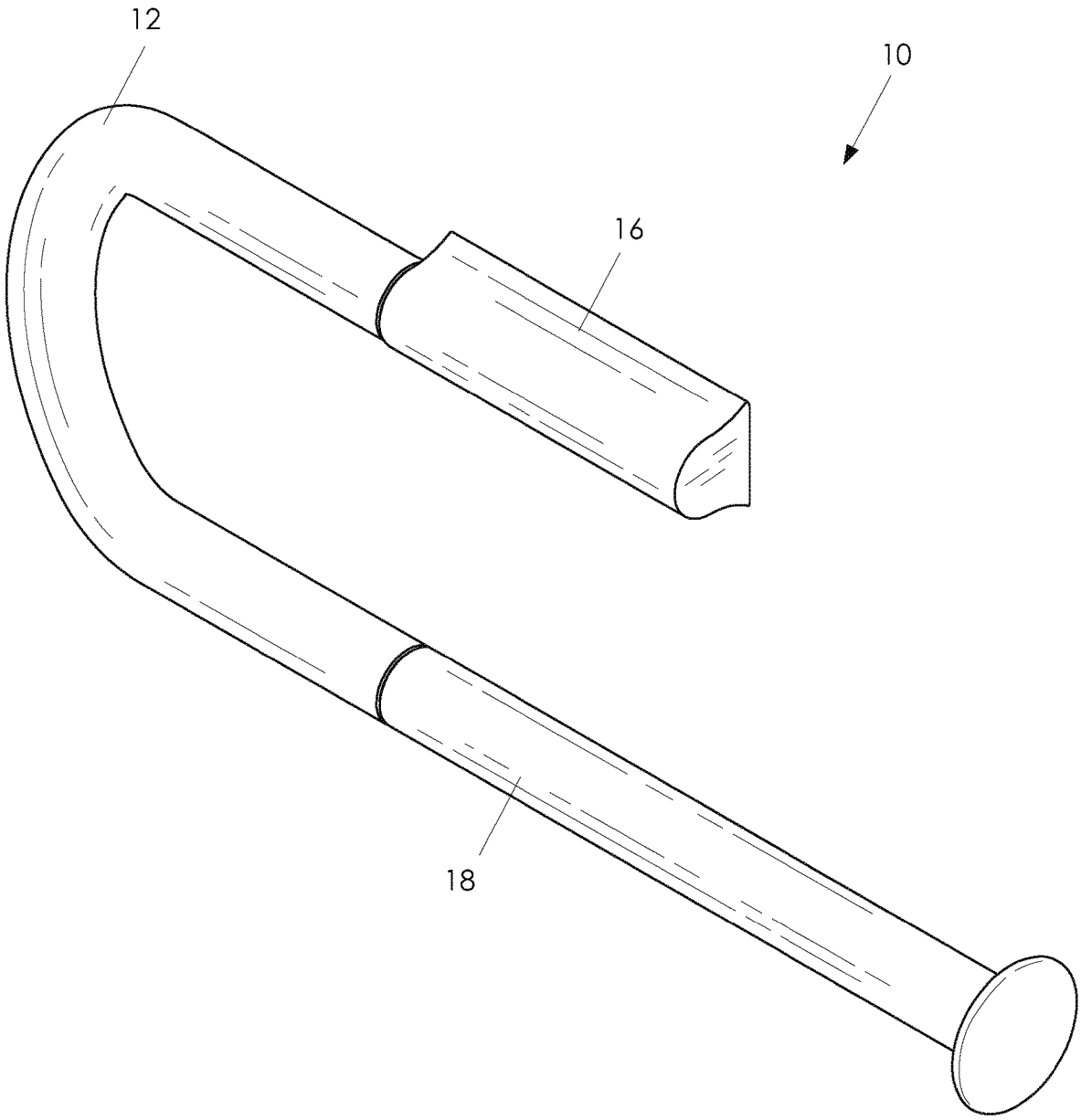
FIG. 1 is a perspective view of an exemplary paper roll holder in a left hand configuration.
Figure 2:
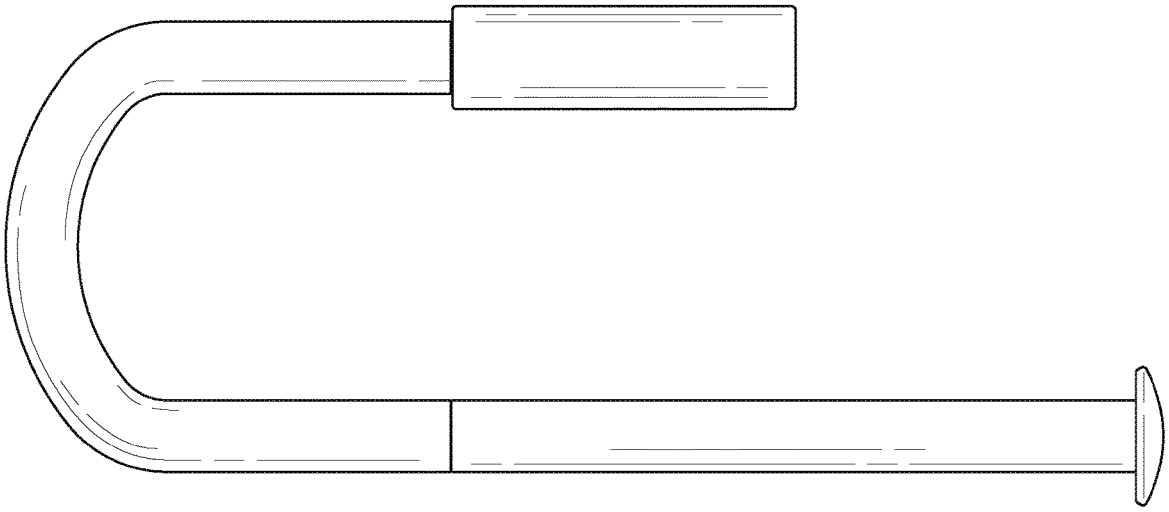
FIG. 2 is a front view of the paper roll holder.
Figure 3:
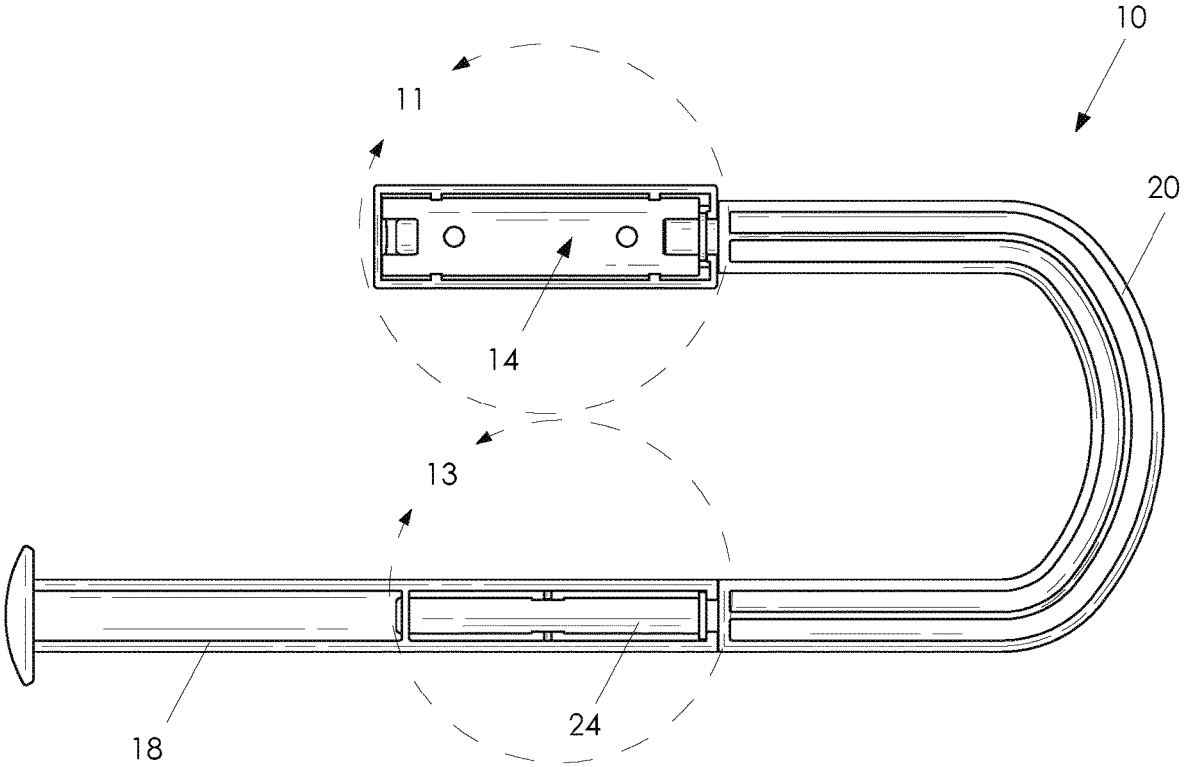
FIG. 3 is a rear view of the paper roll holder.
Figure 4:
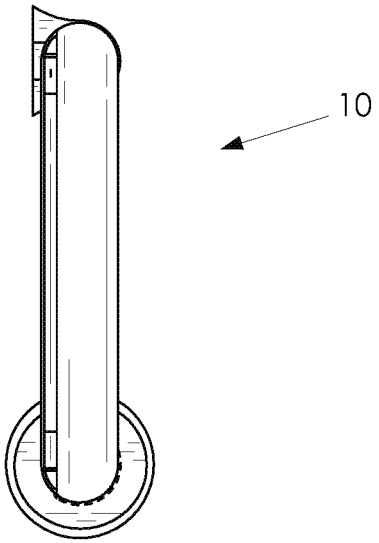
FIG. 4 is a left side view of the paper roll holder.
Figure 5:
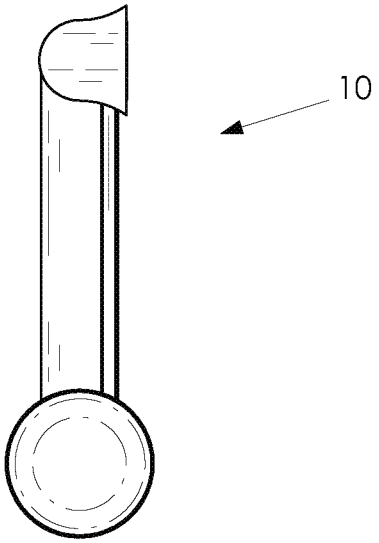
FIG. 5 is a right side view of the paper roll holder.
Figure 6:
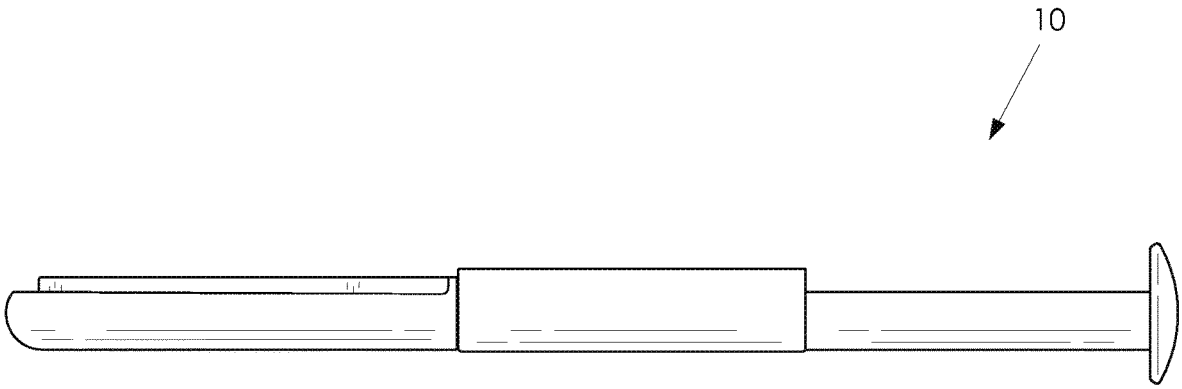
FIG. 6 is a top view of the paper roll holder.
Figure 7:
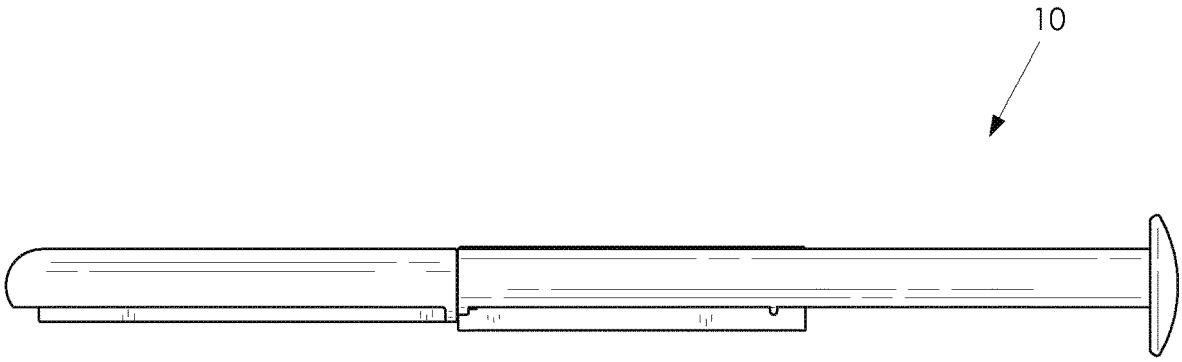
FIG. 7 is a bottom view of the paper roll holder.

The principles of the present application relate to a paper roll holder, such as a paper towel holder, and thus will be described below in this context. It will be appreciated that the principles of the application may be applicable to other holders, such as toilet paper roll holders, etc.

Referring initially to FIGS. 1-8, a reversible paper roll holder is illustrated at reference numeral 10. The roll holder 10 includes a support member 12, a bracket 14, a cover 16, and a support bar 18, which may be any suitable material, such as plastic, and may be formed in any suitable manner, such as injection molding. The support member 12 has a body 20 and a pair of arms 22 and 24 extending from respective ends 26 and 28 of the u-shaped body 20. For a left hand configuration shown in FIG. 1, the arm 22 is held by and pivotable relative to the bracket 14 and secured thereto by the cover 16, and the arm 24 is attached to the support bar 18 that can receive a roll, such as a paper towel roll. For a right hand configuration, the arm 24 is held by and pivotable relative to the bracket 14 and secured thereto by the cover 16, and the arm 22 is attached to the support bar 18.

Figure 8:
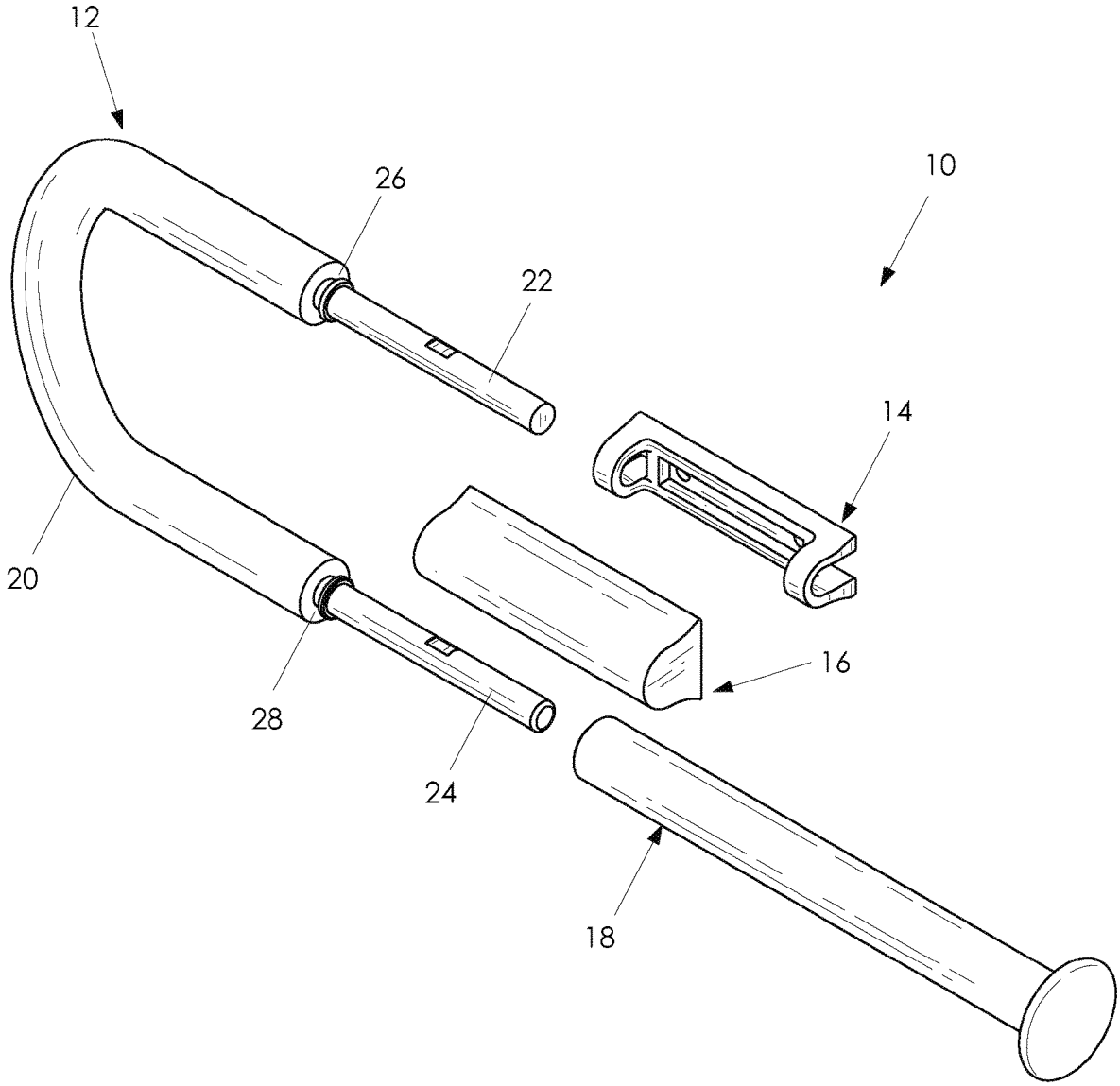
FIG. 8 is a perspective exploded view of the paper roll holder.
Figure 9:
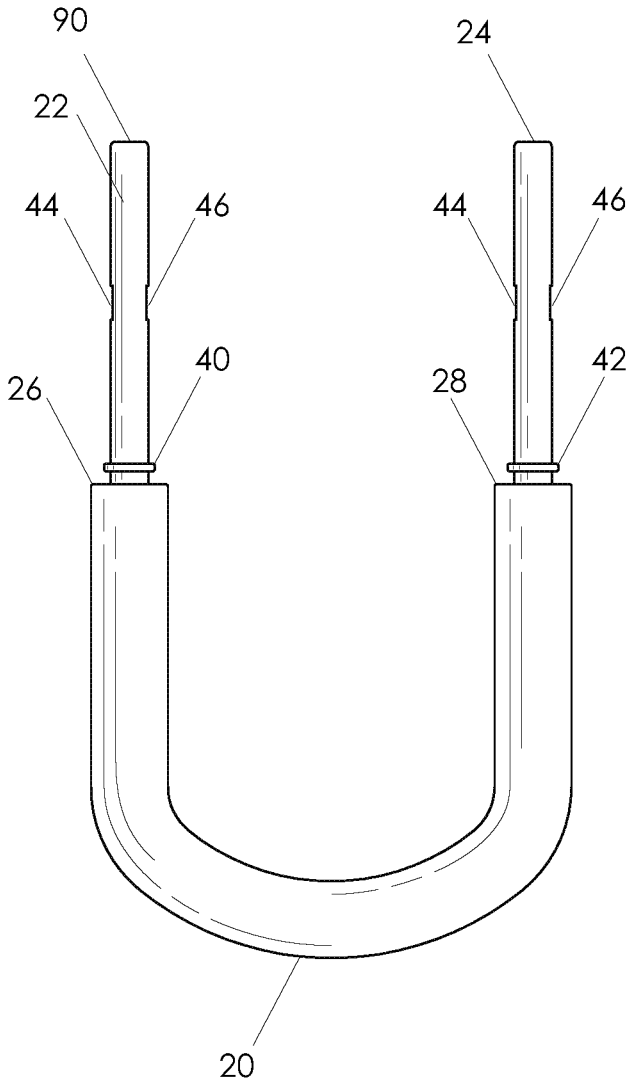
FIG. 9 is a front view of a support member of the paper roll holder.
Figure 10:
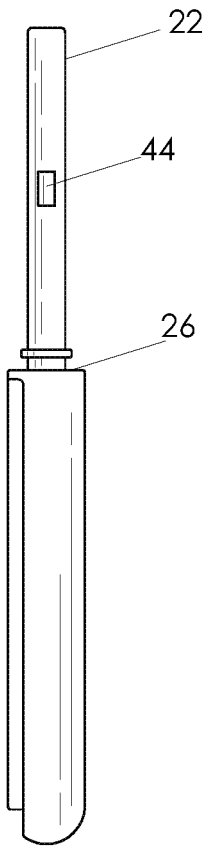
FIG. 10 is a top view of the support member.

Turning now to FIGS. 9 and 10 in addition to FIG. 8, the body 20 of the support member 12 is u-shaped with a c-shaped cross-section and the arms 22 and 24 are substantially cylindrical in shape, although other suitable shapes may be provided. The arms 22 and 24 are integrally formed with the body 20 and each have a diameter that is less than a diameter of the ends 26 and 28 of the body 20. It will be appreciated that the body 20 and the arms 22 and 24 may be formed as separate pieces and connected to one another.

The arms 22 and 24 each have a washer 40, 42 proximate the ends 26 and 28 having a diameter greater than the diameter of the arms 22 and 24 but less than the diameter of the ends 26 and 28. The washers are shown integrally formed with the arms 22 and 24 although it will be appreciated that they could be separate pieces attached to the arms 22 and 24. The washers 40 and 42 are configured to abut either the bracket 14 and cover 16 or the support bar 18, as discussed below and shown in FIGS. 11 and 13, depending on the configuration. The arms 22 and 24 also each have a pair of slots 44 and 46 for engaging with respective protrusions 48 and 50 (FIG. 13) on the support bar 18 depending on the configuration to secure the support bar 18 to the support member 12 and to prevent spinning of the support bar 18 relative to the support member 12.

Turning now to FIGS. 11, 12, 15 and 16 in addition to FIG. 8, the bracket 14 includes a body portion 60 and a pair of ears 62 and 64 projecting from the body portion 60. The body portion 60 has a substantially flat back 66 for abutting a surface, such as a wall, and a recessed portion 68 on a front 70 having a pair of openings 72 and 74 extending therethrough. The openings 72 and 74 each receive a fastener to secure the bracket 14 to the surface, and a head of the fasteners sits in the recessed portion 68 so as to not interfere with the arm 22 or 24. The body portion 60 also includes a pair of grooves 76 and 78 extending along a length of the body portion 60 proximate the back 66 of the body portion 60 that are configured to be engaged by a plurality of protrusions 80 on the cover 16.

The ears 62 and 64 each include a respective opening 84, 86 through which one of the arms 22 and 24 extends when assembled. For example, in the left hand configuration, the arm 22 is advanced through the openings 84 and 86 until the washer 40 abuts an outer end 88 of the ear 62 as shown in FIG. 11, at which point an end 90 of the arm 22 is supported in the opening 86 but does not extend past an outer end 92 of the ear 64.

Figure 11:
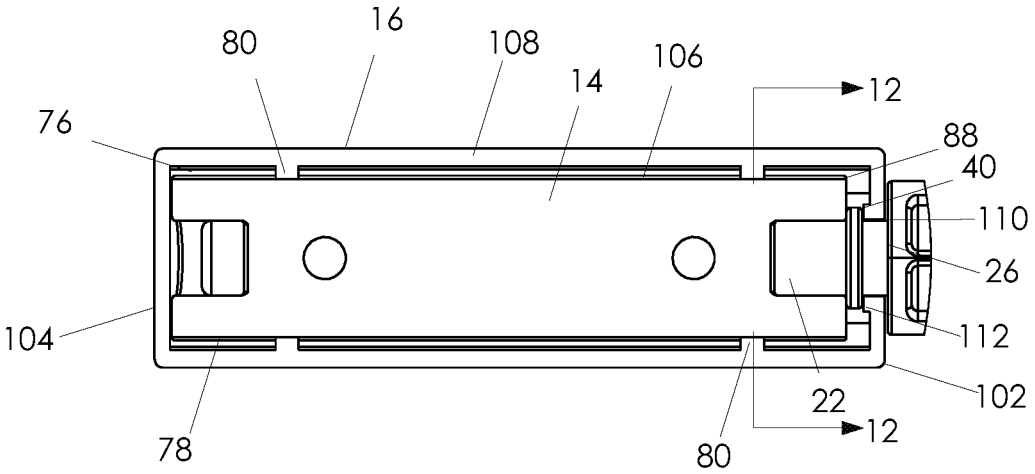
FIG. 11 is an enlarged view of detail 11 in FIG. 3.
Figure 12:
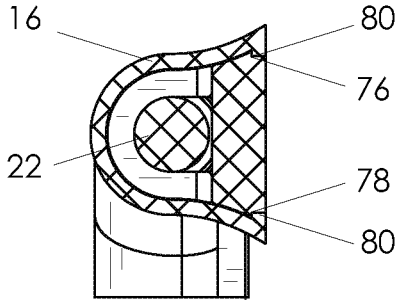
FIG. 12 is a cross-sectional view taken about line 12-12 in FIG. 11.
Figure 17:
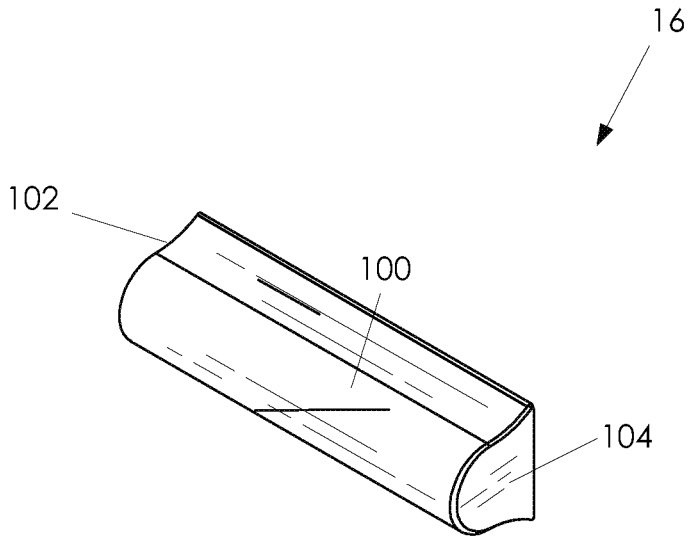
FIG. 17 is a perspective view of a cover of the paper roll holder.
Figure 18:
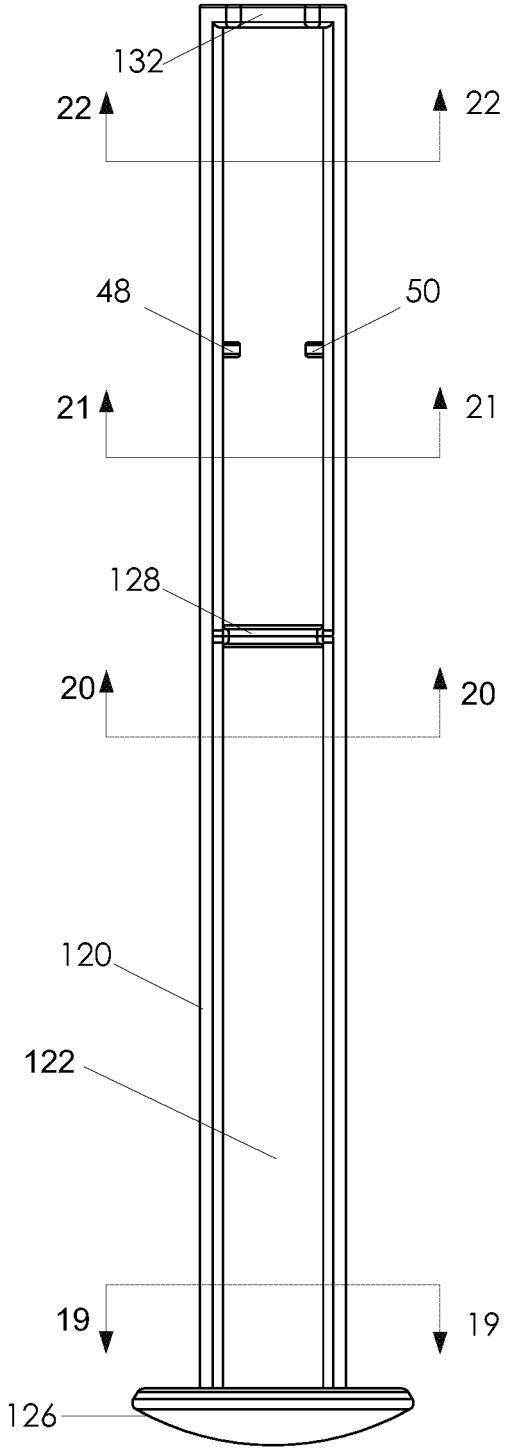
FIG. 18 is a rear view of a support bar of the paper roll holder.

Turning now to FIGS. 11 and 17, the cover 16 has a front portion 100 and first and second side portions 102 and 104 that define a cavity 106 for surrounding the bracket 14 and one of the arms 22 or 24. The protrusions 80 project perpendicular from a base 108 of the front portion 100 for engaging the grooves 76 and 78. The protrusions 80 are deflectable such that they can snap into the grooves 76 and 78 during installation and be deflected out of the grooves 76 and 78 during removal.

The first side portion 102 includes a slot 110 that receives an end of one of the arms 22 or 24 when installed over the bracket 14. As shown in FIG. 11, protruding inward from the first side portion 102 at edges of the slot 110 are protrusions 112 that abut the washer 40. An outer surface of the first side portion 102 abuts the end 26 of the body 20 and an inner surface of the second side portion 104 abuts the outer end 92 of the ear 64 preventing the cover 16 from sliding laterally.

Turning now to FIGS. 13, 14 and 18-22, the support bar 18 includes a C-shaped body 120 having an inner and outer surface 122 and 124 and an end cap 126 integrally formed with the body 120, although it will be appreciated that they may be formed as separate pieces and coupled together. The end cap 126 has a diameter that is greater than a diameter of the body 120 to abut an end of a paper roll to help prevent unintentional removal of the paper roll from the support bar 18. The diameter of the body 120 is the same or substantially the same as the diameter of ends 26 and 28 of the u-shaped body 20 to allow the outer surface 124 of the support bar 18 to be flush with the body 20.

Figure 13:
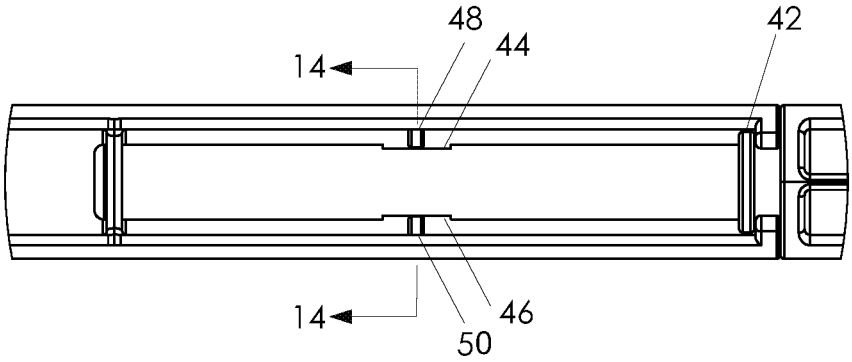
FIG. 13 is an enlarged view of detail 13 in FIG. 3.
Figure 14:
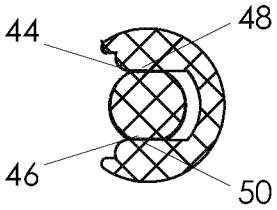
FIG. 14 is a cross-sectional view taken about line 14-14 in FIG. 13.
Figure 15:
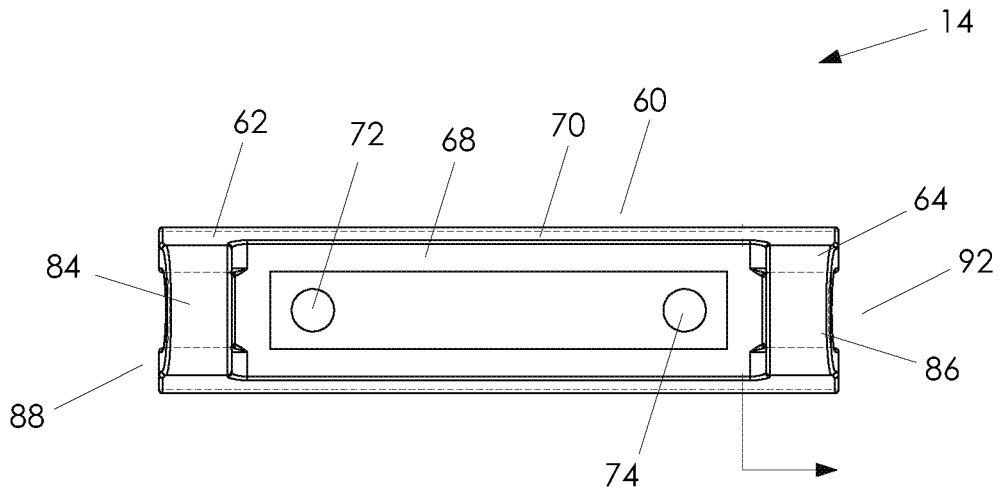
FIG. 15 is a front view of a bracket of the paper roll holder.
Figure 16:
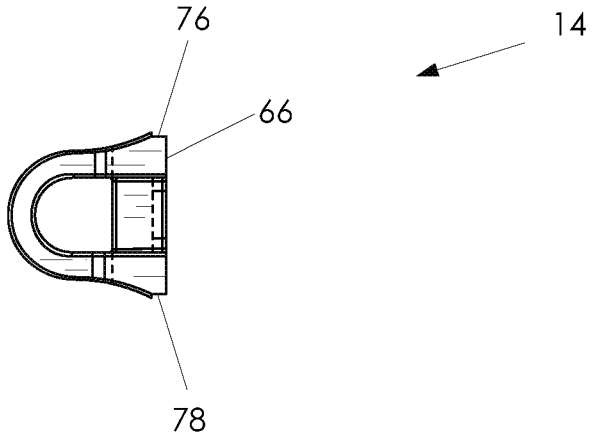
FIG. 16 is a side view of the bracket.
Figure 22:
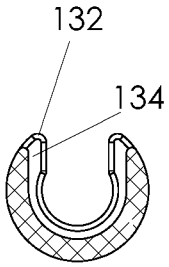
FIG. 22 is a cross-sectional view taken about line 22-22 in FIG. 18
Figure 21:
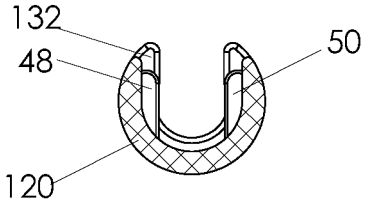
FIG. 21 is a cross-sectional view taken about line 21-21 in FIG. 18.
Figure 20:
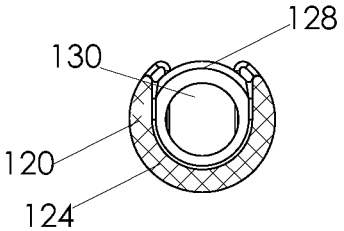
FIG. 20 is a cross-sectional view taken about line 20-20 in FIG. 18.
Figure 19:
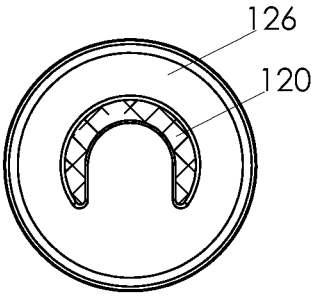
FIG. 19 is a cross-sectional view taken about line 19-19 in FIG. 18.

The support bar 18 also has the protrusions 48 and 50 extending radially inward from the inner surface 122 of the body 20 as shown in FIG. 21, a washer 128 having an opening 130 and extending from the inner surface 126 as shown in FIG. 20, and an end portion 132 that defines a slot as shown in FIG. 22 through which one of the arms 22 or 24 extends. In the left hand configuration, the arm 24 extends through the opening 130 as shown in FIG. 13, the protrusions 48 and 50 engage the slots 44 and 46 in the arm 24, the end 28 of the body 20 abuts the end portion 132, and the washer 42 abuts an inner surface 134 of the end portion 122.

To assemble the roll holder 10 in the left hand configuration as shown in FIGS. 1-22, the bracket 14 is attached to the surface, such as the wall, by fasteners that extend through the openings 72 and 74 into the wall and that have heads that abut the openings 72 and 74 and sit in the recessed portion 68. The arm 22 of the support member 12 is then advanced through the openings 84 and 86 in the ears 62 and 64 until the washer 40 on the arm 22 abuts the outer end 88 of the ear 62. The cover 16 is then positioned over the bracket 14 such that an inner surface of the second side portion 104 abuts the outer end 92 of the ear 64, the protrusions 112 abut the washer 40, the outer surface of the first side portion 102 abuts the end 26 of the body 20, and the protrusions 80 of the cover are engaged with the grooves 76 and 78 of the bracket 14. The support bar 18 can then be attached to the arm 24 by advancing the arm 24 through the opening 130 of the washer 128 until the protrusions 48 and 50 engage the slots 44 and 46 in the arm 24, the end 28 of the body 20 abuts the end portion 132, and the washer 42 abuts an inner surface 134 of the end portion 122. It will of course be appreciated that the components can be installed in any suitable order, for example the support bar 18 can be attached to the support member 12 prior to attachment to the bracket 14.

To disassemble the roll holder, the support bar 18 is disengaged from the arm 24, the cover 16 is disengaged from the bracket 14, the arm 22 is removed from the ears 62 and 64, and then the bracket 14 is detached from the wall.

Figure 23:
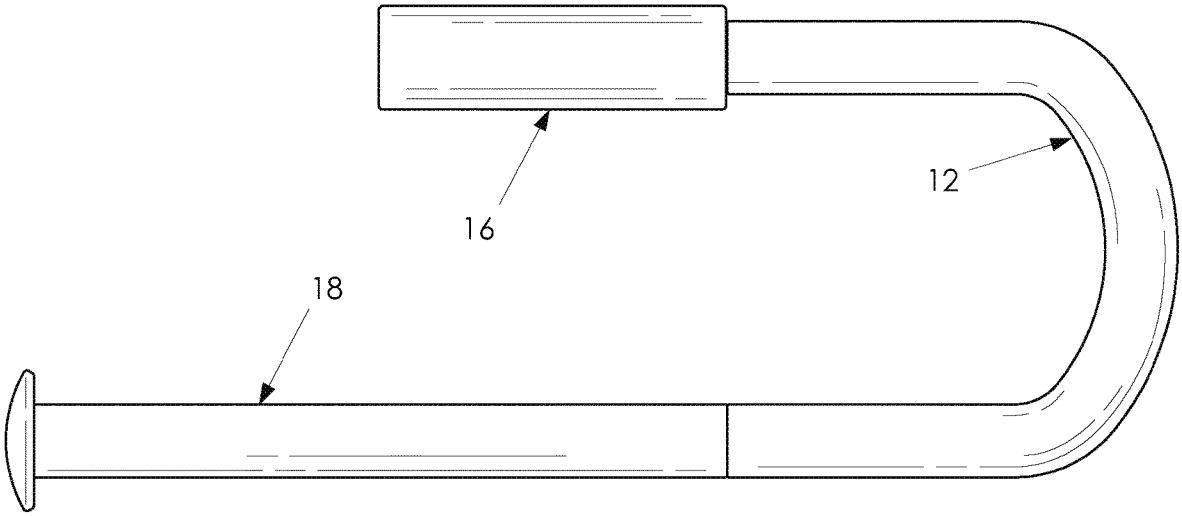
FIG. 23 is front view of the paper roll holder in a right hand configuration.
Figure 24:
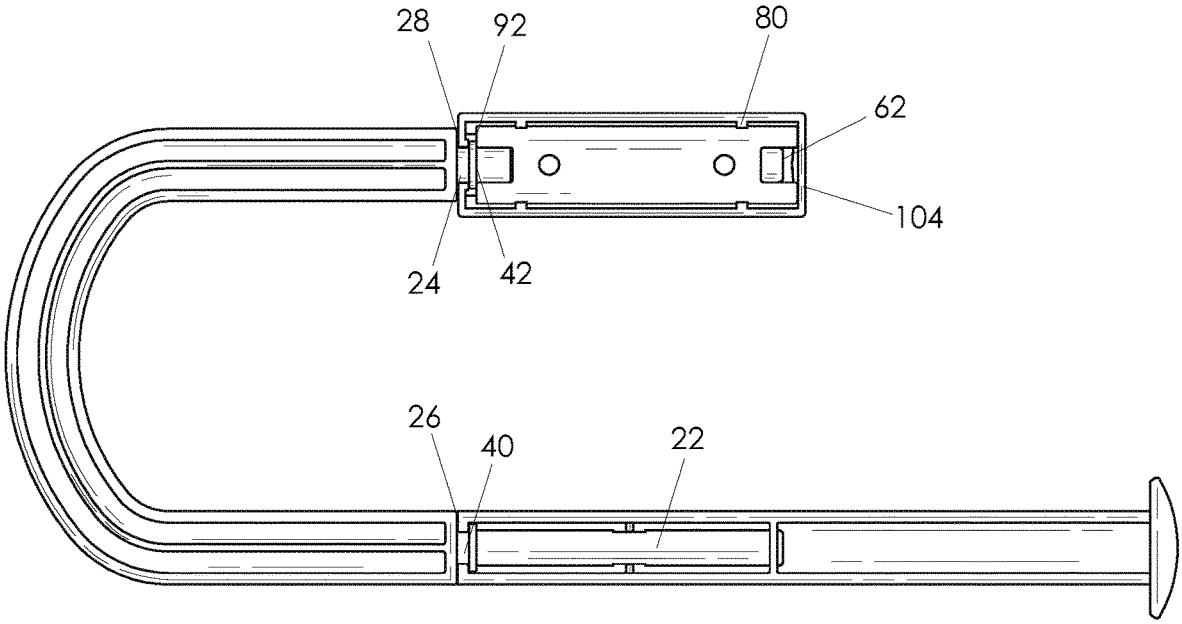
FIG. 24 is a rear view of the paper roll holder in the right hand configuration.

To assemble the roll holder 10 in the right hand configuration as shown in FIGS. 23 and 24, the bracket 14 is attached to the surface as discussed above, and then the arm 24 of the support member 12 is advanced through the openings 86 and 84 in the ears 64 and 62 until the washer 42 on the arm 24 abuts the outer end 92 of the ear 64. The cover 16 is then positioned over the bracket 14 such that an inner surface of the second side portion 104 abuts the outer end 88 of the ear 62, the protrusions 112 abut the washer 42, the outer surface of the first side portion 102 abuts the end 28 of the body 20, and the protrusions 80 of the cover are engaged with the grooves 76 and 78 of the bracket 14. The support bar 18 can then be attached to the arm 22 by advancing the arm 22 through the opening 130 of the washer 128 until the protrusions 48 and 50 engage the slots 44 and 46 in the arm 22, the end 26 of the body 20 abuts the end portion 132, and the washer 40 abuts an inner surface 134 of the end portion 122. It will of course be appreciated that the components can be installed in any suitable order.

By providing an assembly that is reversible such that it can be mounted in a left hand and a right hand configuration with the same components, the roll holder 10 minimizes waste because extra components do not need to be provided to an end user to mount in the different configurations. This also allows a user to change configuration at a later date without have to store and then find additional pieces required to change configuration.

Although certain embodiments have been shown and described, it is understood that equivalents and modifications falling within the scope of the appended claims will occur to others who are skilled in the art upon the reading and understanding of this specification.

What is claimed is:

1. A holder including:

a support member having first and second arms extending from first and second ends of the body respectively, each of the first and second arms having one or more slots;

a bracket configured to be mounted to a surface and including one or more openings through which one of the first and second arms extends;

a cover attachable to the bracket to hold the support member in position relative to the bracket and to cover the bracket; and a support bar having at least one protrusion extending radially inward from an inner surface of the body for engaging in the one or more slot of the other of the first and second arms to removably secure the support bar to the support member.

2. The holder according to claim 1, wherein the first and second arms each have a washer surrounding each said first and second arms proximate the respective end of the body, each washer having a diameter greater than a diameter of the respective arm and less than a diameter of the respective end.

3. The holder according to claim 1, wherein the bracket includes a body portion and a pair of ears projecting from the body portion.

4. The holder according to claim 3, wherein the one or more openings in the bracket includes a pair of openings, and wherein each ear includes one of the pair of openings through which the one of the first and second arms extends.

5. The holder according to claim 1, wherein the bracket includes a first groove extending along a length of the bracket at a top of the bracket and a second groove extending along the length of the bracket at a bottom of the bracket.

6. The holder according to claim 5, wherein the cover has a curved front portion and first and second side portions on opposite sides of the curved front portion to define a cavity for surrounding the bracket and the one of the first and second arms.

7. The holder according to claim 6, wherein the cover includes a plurality of protrusions projecting from a base of the front portion for engaging the first and second grooves to removably attach the cover to the bracket.

8. The holder according to claim 6, wherein the first side portion includes a slot through which the one of the first and second arms extends into the cavity, and wherein an outer surface of the first side portion abuts the respective end of the body and an inner surface of the first side portion abuts a washer surrounding the one of the first and second arms.

9. The holder according to claim 1, wherein the support bar has an end that abuts the respective end of the body, and wherein the support bar has a diameter equal to a diameter of the body.

10. The holder according to claim 9, wherein the end of the support bar defines a slot through which the other of the first and second arm extends, wherein an outer surface of the end of the support bar abuts the respective end of the body and an inner surface of the end of the support bar abuts a washer surrounding the other of the first and second arms.

11. The holder according to claim 1, wherein the support bar includes a washer having an opening and extending from the inner surface, and wherein the other of the first and second arms extends through the washer.

12. A reversible holder including:

a support member having a body and a pair of arms extending from the body parallel one another, each of the arms having a pair of slots;

a bracket that holds one of the arms of the support member to allow the support member to pivot relative to the bracket; and a support bar removably and non-rotatably attached to the other of the arms, the support bar having a c-shaped body with a pair of protrusions extending inward from an inner surface of the c-shaped body, wherein one of the pair of arms is attached to the support bar for a right hand configuration and the other of the pair of arms is attached to the support bar for a left hand configuration, and wherein the support bar surrounds the other of the arms and the pair of protrusions engage respective ones of the pair of slots.

13. The reversible holder according to claim 12, further including a cover attached to the bracket to cover the bracket and prevent axial movement of the one of the arms held by the bracket while allowing rotational movement of the one of the arms.

14. The reversible holder according to claim 13, wherein each of the pair of arms has a washer surrounding the arm, the washer configured to abut an inner end of either the cover or the support bar.

15. The reversible holder according to claim 12, wherein the support bar has a diameter equal to a diameter of the body of the support member.

16. The reversible holder according to claim 12, wherein the support bar has an end that defines a slot through which the other of the arms extends.

17. A reversible paper roll holder including:

a support member having a body and first and second arms extending from respective ends of the body, each arm having one or more slots;

a bracket configured to be mounted to a surface and including one or more openings through which one of the first and second arms extends;

a cover attachable to the bracket to hold the support member in position relative to the bracket and to cover the bracket; and a support bar having a body and at least one protrusion extending radially inward from an inner surface of the body for engaging in the one or more slot of the other of the first and second arms to removably secure the support bar to the support member, wherein in a left hand configuration the first arm extends through the one or more openings in the bracket and the support bar engages in the one or more slots in the second arm, and in a right hand configuration the second arm extends through the one or more openings in the bracket and the support bar engages in the one or more slots in the first arm.

18. The reversible paper roll holder according to claim 17, wherein the first and second arms each have a washer surrounding each said first and second arms proximate the respective end of the body, wherein an end of the cover is abutted by one of the ends of the body and the washer of the one of the first and second arms, and wherein an end of the support bar is abutted by the other end of the body and the washer of the other of the first and second arms.

19. The reversible paper roll holder according to claim 17, wherein the bracket includes a body portion and a pair of ears projecting from the body portion.

* * * * *